United States Patent [19]

Verboom

[11] 4,255,882

[45] Mar. 17, 1981

[54] DRAGGING TYPE CUTTER HEAD FOR A SUCTION DREDGER

[75] Inventor: Pieter Verboom, Alblasserdam, Netherlands

[73] Assignee: I.H.C. Holland N.V., Rotterdam, Netherlands

[21] Appl. No.: 16,740

[22] Filed: Mar. 2, 1979

[30] Foreign Application Priority Data

Mar. 2, 1978 [NL] Netherlands ..... 7802310

[51] Int. Cl.[3] ..... E02F 3/88

[52] U.S. Cl. ..... 37/66; 37/58

[58] Field of Search ..... 37/66, 64, 58, 72, 195

[56] References Cited

U.S. PATENT DOCUMENTS

| | | | |
|---|---|---|---|
| 411,183 | 9/1889 | Bowers | 37/66 |
| 826,993 | 7/1906 | Coiseaa | 37/66 |
| 1,106,038 | 8/1914 | Fruhling | 37/66 |
| 1,701,280 | 2/1929 | Sorensen | 37/66 |
| 2,999,324 | 9/1961 | Ohlhausen | 37/67 |
| 3,171,220 | 3/1965 | Schram | 37/66 |
| 4,083,134 | 4/1978 | Oterdoom | 37/66 X |

FOREIGN PATENT DOCUMENTS

| | | | |
|---|---|---|---|
| 2010614 | 3/1970 | Fed. Rep. of Germany | 37/66 |
| 363002 | 4/1906 | France | 37/66 |
| 1679 | 11/1916 | Netherlands | 37/66 |
| 7513146 | 5/1977 | Netherlands | 37/58 |
| 1383089 | 2/1975 | United Kingdom | 37/72 |

*Primary Examiner*—Clifford D. Crowder

*Attorney, Agent, or Firm*—Young & Thompson

[57] ABSTRACT

A dragging type suction head for a suction dredger having a suction tube which extends downwardly and rearwardly from a vessel at the lower end of which the suction head is mounted. In this suction head, enclosed by a housing which at least at a rear side leaves free an entrance opening, a cutter is mounted rotating in a direction opposite the direction of dredging, said cutter being a cylindrical body with cutting blades at its circumference which blades feed immediately into an intake section connected to the suction tube. Between the inner edges of the cutting blades and a cylindrical drum, space is provided to allow for a passage through which water can flow. The blades are mounted between discs that have sharp cutting edges.

8 Claims, 3 Drawing Figures

DRAGGING TYPE CUTTER HEAD FOR A SUCTION DREDGER

Figure 3:
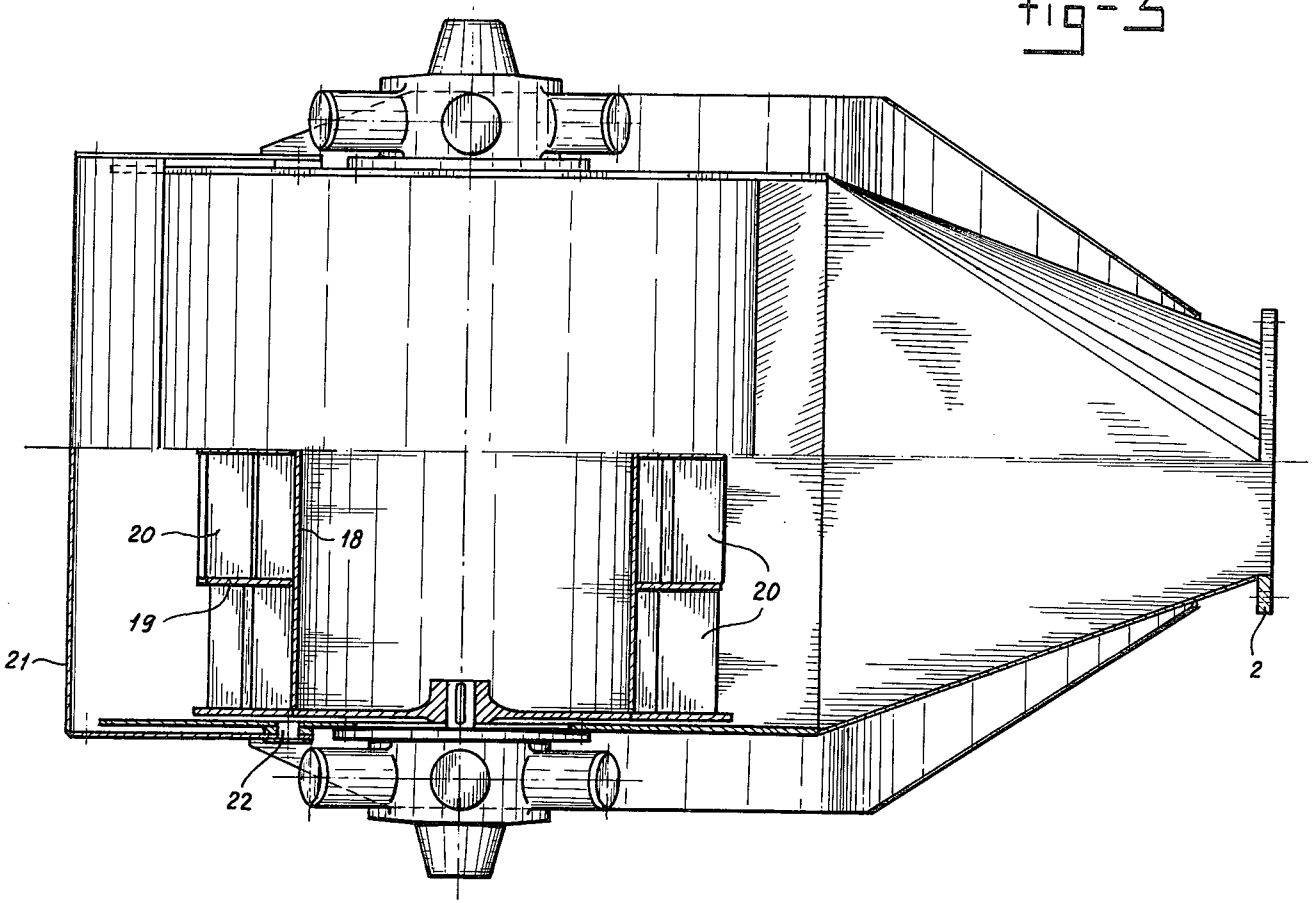

The invention relates to a dragging type cutter head for a suction dredger, said head being provided with a cutting means adapted to be driven in rotation, that has been mounted before the mouth of the suction conduit and consists of a substantially cylindrical body having cutting blades and being rotatable about a horizontal axis, said cutting means being operative in a cutting direction opposite to the dragging direction. A similar dragging type cutter is known from Dutch Patent Application No. 73 11208 laid open to inspection, particularly from FIG. 3 showing a dragging type head having two rotary cutting means rotating in opposite directions. Other embodiments according to this reference employ the combination of a fixed cutting means operative in a direction opposite to the dragging direction and a rotary cutting means operative in the same direction as the dragging direction. In this known dragging type head the cutting means have been constructed in such a manner that in difficultly dredgable strata such as clay, the teeth or blades are subject to clogging.

The disposition in the suction head of a rotary cutting means operative in the dragging direction is the of known construction as is apparent from for instance the German Patent Specification No. 512,627.

The object of the invention is to provide a dragging type cutter head having a simple construction and operating very efficiently in coherent types of soil such as argillaceous difficultly dredgable soil.

According to the invention this object is attained in the first place by providing only one cutting means in the form of a rotatable cylindrical body operative opposite to the dragging direction while the edges of the intake opening of the suction conduit extend to the said body, the lower edge of said opening being present on the level with the lower part of the cutting means. Consequently the rotary cutting means is located in a position in which said cutting means severs pieces of earth and impels the same immediately in the intake of the suction conduit with the aid of the water current also concentrating at the same place. Consequently an immediate cleaning of the blades occurs with certainty.

Moreover it is now possible to obtain smaller pieces of severed earth at a higher speed of rotation this being conducive to a decrease of the dragging resistance. Accordingly it is no longer necessary to provide a visor for sealing the cutter as much as is possible with respect to the surrounding earth.

Whereas in the known dragging type cutters the cutting means serve to sever the earth, the transportation of which is left to the water current, the location of the cutting means according to the invention, the direction of rotation thereof and the construction thereof provide for an acceleration of the severed pieces of earth in the transportation direction and an immediate entry thereof in the suction mouth partly due to the centrifugal effect and partly due to the water current concentrating at that place. Consequently the pieces of earth immediately leave the cutting means in an outward direction without clogging the said cutting means. That is, the severing operation is performed at a location at which an acceleration of the flow rate occurs.

Accordingly the cutting means is preferably designed in such a manner that there is a substantially closed cylinder barrel between the cutting blades and the axis.

It is however not necessary that it possesses a circular section. Hence due to a reduction of the cross section of the current passage there may be imparted such an intensity to the flow rate at the site of the operative blades or teeth that no clogging of the blades or teeth occurs. In other words the severing operation is performed in a high flow rate area in direct abutment with the suction mouth, this enabling a very effective operation.

In the cutter head as shown in FIG. 3 of the above mentioned Dutch Patent Application No. 73 11208 the rotary cutter means operative in the direction opposite to the dragging direction is present at a great distance from the intake mouth of the suction conduit, i.e. at the site of the visor.

According to the invention the cutting means consists preferably of a plurality of discs or rings perpendicular to the axis, between which discs or rings the cutting blades have been mounted. Consequently it becomes possible to use shorter and accordingly also thinner cutting blades which moreover may be mounted in a staggered position with respect to each other in order to distribute the incurring load. Preferably the discs have a sharp peripheral edge, there being preferred especially an embodiment in which the cutting edges of the blades coincide with the outer edge of the discs the latter at the location of each blade having a leading cutting edge making an acute angle with the radius. Accordingly each disc acquires the shape of a dentated disc in which the front face of each tooth constitutes a cutting edge, the cutting edge of the cutting blades in the traverse direction thereto being present at the location of the crest of the teeth.

The inventive dragging type cutter head is particularly suited for sticky material such as siliceous loam since the concentrated water current changes the direction of the severed peel and cleans the blades by rinsing. Because of the divergent positioning of the cutting blades any encountered solid objects such as cobbles are discharged easily.

Figure 1:
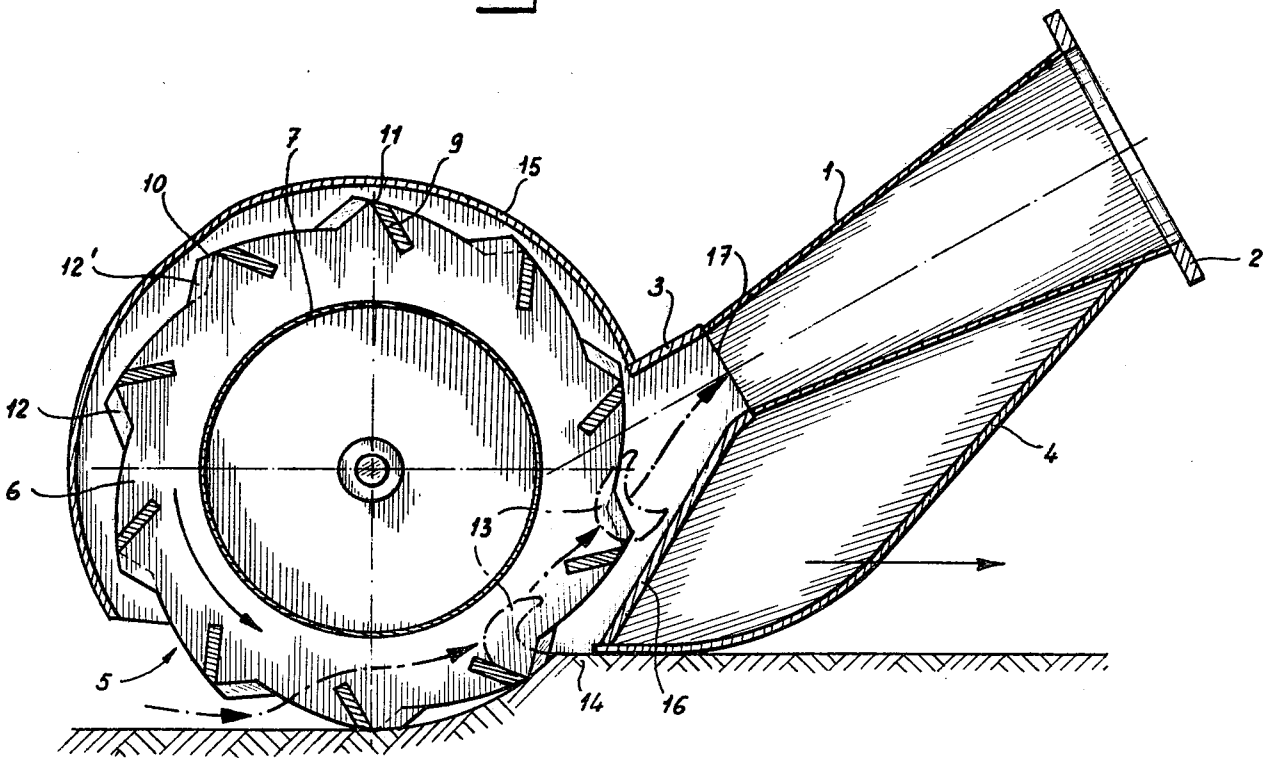
Figure 2:
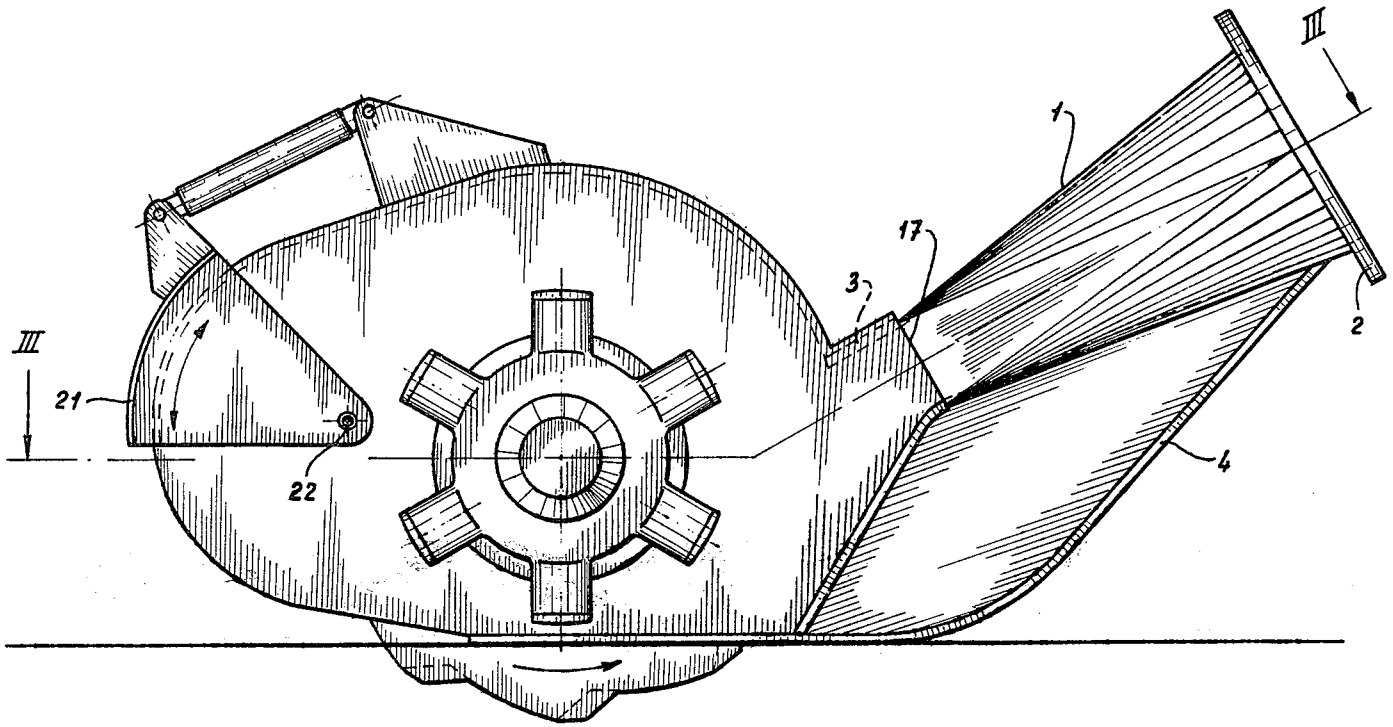

The invention will now further be elucidated with reference to the drawings, in which FIG. 1 shows a sectional view schematically disclosing the principle of the dragging type cutter head according to the invention;

FIG. 2 shows a side elevation of an embodiment of the dragging type cutter head according the invention; and FIG. 3 shows a plan view partly insection on the line III—III in FIG. 2;

Referring to FIG. 1 there is shown a dragging type cutter head consisting of a conduit 1 connected to a not-shown suction conduit by means of the connecting flange 2 and having a suction mouth at 3.

At the lower side there has been provided a slide plate 4 by means of which the head may rest on the bottom. This dragging type head comprises a rotatable cutting means 5 consisting of a plurality of discs or rings 6 and a cylindrical barrel 7.

Between the discs or rings there have been provided the cutting blades 9 in a uniform distribution about the circumference.

The disks or rings 6 possess a dentated periphery having crests 10 coinciding with the cutting edges 11 of the blades 9 and possessing a cutting face 12–12' at the leading side of each toothed part. These cutting faces 12–12' have alternatively an opposite direction, i.e. operative to the left and operative to the right, respectively. This cutting means 5 is driven by non-illustrated means.

From FIG. 1 it is apparent how the earth is severed by means of the cutting blades 9 as shown at 13.

The water current is concentrated both between the lower side of the cylinder barrel 7 and the earth 14 and between the upper side of the cylinder barrel 7 and the cutting blades present on the upper side. Between the cutting blades 9 present in the upper part and a screen 15 the current flows in opposite direction due to the rotational direction of the cutting means 5. Accordingly it is achieved with certainty that the blades are rinsed clean because between the upper part of the barrel 7 and the lower side of the cutting blades 9 present on the upper part the flow will be directed towards the suction mouth 8. Moreover there will then occur a turbulence in the upper part.

The lower part 16 of the mouth 3 of the suction conduit 1 extends substantially tangentially to the rotary circle of the cutting means 5 and the edges of this mouth 3, 16 come so close to the cutting means 5 that the latter essentially penetrates into the plane of the mouth. Accordingly severed pieces of earth 13 are immediately brought into the mouth 3 due to the strong outwardly directed flow and the centrifugal effect thereafter to be discharged under the influence of the flow rate, this flow rate steadily increasing due to the venturi 17. With this construction according to the invention a visor is not necessary anymore. A visor may however yet be employed for controlling the concentration. The visor determines, as is evident, the dimensions of the suction slit of the head with respect to the bottom and consequently the amount of water drawn from the surrounding water body.

With reference to FIGS. 2 and 3 there is shown in greater detail an embodiment of the inventive dragging type cutter head.

As shown in FIG. 3 the cutting means consists of a cylinder barrel 18 on which a plurality of annular discs 19 have been mounted between which cutting blades 20 are present.

From FIG. 3 it will apparent that the cutting means 20 may be mounted in a staggered position with respect to each other, i.e. in the peripheral direction at small distances with respect to each other so that they come successively into operative engagement with the earth. They may however also be positioned in a helical arrangement.

It will be evident from FIGS. 2 and 3 that the embodiment shown therein has been provided with a visor 21 rotatably mounted on a hinge pin 22.

What is claimed is:

1. A dragging type suction head for a suction dredger, said suction head being mounted at the lower end of a suction tube adapted to extend obliquely downwardly and rearwardly from a vessel, said suction head having a single driven cutter rotatable about a horizontal axis which extends transverse to the direction of dragging, said rotatable cutter having the form of a substantially cylindrical body with transversely extending cutting blades at its outer circumference, said cutter in operation rotating in a direction such that the cutter blades counteract the direction of dragging, said cutter being enclosed by a housing which in the region below the axis of rotation of the cutter leaves free an entrance opening at least at the rear side of the cutter, said housing being connected to the suction tube opposite said rear entrance by a suction tube intake portion of which the lower edge is at a level of a support (4) by means of which the suction head can rest upon unstirred soil in front of the cutter with respect to the direction of dragging, the cutter comprising a closed cylindrical body concentric with said axis of rotation and spaced within the inner edges of the cutter blades.

2. The dragging type suction head of claim 1, wherein the lower wall of said intake portion extends from the said lower edge toward the suction tube in a plane parallel to the axis of rotation of the cutter.

3. The dragging type suction head according to claim 1, wherein the cutter blades are mounted between a plurality of annular discs spaced apart in the axial direction of the axis of rotation.

4. The dragging type suction head according to claim 3, wherein adjacent cutting blades are staggered slightly with respect to each other seen in a direction parallel to the axis of rotation of the cutter.

5. The dragging type suction head according to claim 3, wherein the annular discs at their circumference have a series of sharp edges which are leading with respect to the direction of rotation and extend at an angle to the radius.

6. The dragging type suction head according to claim 5, wherein the cutting edges of the blades are placed at the radially outer rear ends of the said sharp edges.

7. The dragging type suction head according to claim 5, wherein said sharp edges on said annular discs are defined by beveled surfaces on said discs that are disposed on alternately opposite sides of said disc about the periphery of each said disc.

8. The dragging type suction head of claim 1, in which said suction tube intake portion and said support diverge from said lower edge at an acute angle to each other.

* * * * *